US010687411B2

(12) United States Patent
Crowe

(10) Patent No.: US 10,687,411 B2
(45) Date of Patent: Jun. 16, 2020

(54) PLASMA ARC TORCH NOZZLE WITH VARIABLY-CURVED ORIFICE INLET PROFILE

(71) Applicant: Thermacut, k.s., Uherske Hradiste (CZ)

(72) Inventor: George A. Crowe, Claremont, NH (US)

(73) Assignee: THERMACUT, K.S., Uherskehradiste (CZ)

( * ) Notice: Subject to any disclaimer, the term of this patent is extended or adjusted under 35 U.S.C. 154(b) by 787 days.

(21) Appl. No.: 15/230,505

(22) Filed: Aug. 8, 2016

(65) Prior Publication Data

US 2017/0048961 A1 Feb. 16, 2017

Related U.S. Application Data

(60) Provisional application No. 62/204,026, filed on Aug. 12, 2015.

(51) Int. Cl.
*H05H 1/34* (2006.01)

(52) U.S. Cl.
CPC ..... *H05H 1/3405* (2013.01); *H05H 1/34* (2013.01); *H05H 2001/3478* (2013.01)

(58) Field of Classification Search
CPC ..... B23K 9/24; B23K 10/00; B23K 10/02; B23K 26/1462; B23K 26/1464; H05H 1/26; H05H 1/28; H05H 1/32; H05H 1/34; H05H 1/3405; H05H 2001/3478; H05H 2001/3484; H05H 2001/3494
USPC ..... 219/121.5, 121.51, 121.48, 121.39, 75, 219/121.49, 123, 121.11, 7, 6.16; 239/79, 239/80, 81, 548, 132.3, 419, 423, 424, 239/DIG. 7; 313/156, 231.41
See application file for complete search history.

(56) References Cited

U.S. PATENT DOCUMENTS 2,175,160 A * 10/1939 Zobel ..... F23D 14/54 239/589
2,906,858 A * 9/1959 Morton, Jr. ..... H05H 1/3405 219/121.5
2,919,370 A * 12/1959 Giannini ..... H05H 1/26 313/231.31
3,075,065 A * 1/1963 Buhler ..... B05B 7/226 219/75

(Continued)

*Primary Examiner* — Dana Ross
*Assistant Examiner* — Ket D Dang
(74) *Attorney, Agent, or Firm* — Warner Norcross + Judd LLP

(57) ABSTRACT

A nozzle for a plasma arc torch has a longitudinal nozzle axis, a nozzle orifice with a generally cylindrical orifice sidewall centered on the nozzle axis, and an orifice inlet that is formed as a surface of rotation about the nozzle axis; a gas-directing surface may also be provided. The orifice inlet has a variably-curved surface generated by rotating a variably-curved element about the nozzle axis, where the variably-curved element can be a portion of an ellipse, parabola, or hyperbola, and can join to the orifice sidewall and to the gas-directing surface, if provided. Both the orifice sidewall and the gas directing surface can each join the variably-curved element in a substantially tangential manner. Using an elliptical contour for the orifice inlet was found to increase stability for the plasma arc, providing improved cut quality and faster cutting speed for the torch.

8 Claims, 4 Drawing Sheets

(56) References Cited

U.S. PATENT DOCUMENTS

| | | | | |
|---|---|---|---|---|
| 3,242,305 | A | 3/1966 | Kane et al. | |
| 3,242,308 | A * | 3/1966 | Yamamoto | G01N 21/73 219/123 |
| 4,540,121 | A * | 9/1985 | Browning | B05B 7/16 219/121.47 |
| 4,909,914 | A * | 3/1990 | Chiba | B01J 19/26 118/715 |
| 4,967,055 | A | 10/1990 | Raney et al. | |
| 5,164,568 | A | 11/1992 | Sanders | |
| 5,782,414 | A | 7/1998 | Nathanson | |
| 5,897,059 | A * | 4/1999 | Muller | H05H 1/28 219/121.48 |
| 5,977,510 | A | 11/1999 | Lindsay | |
| 7,544,913 | B2 * | 6/2009 | Helenius | H05H 1/28 219/121.48 |
| 8,698,036 | B1 | 4/2014 | Zhang et al. | |
| 2014/0346151 | A1 * | 11/2014 | Crowe | H05H 1/28 219/121.49 |

* cited by examiner

-PRIOR ART-

PLASMA ARC TORCH NOZZLE WITH VARIABLY-CURVED ORIFICE INLET PROFILE

FIELD OF THE INVENTION

The present invention relates to an improved nozzle for constraining the flow of plasma gas in a plasma arc torch, the improved nozzle having an orifice inlet profile that has been found to provide increased stability while allowing increased gas pressure and flow, resulting in improved cut quality and faster cutting speed.

BACKGROUND

Plasma arc torches employ a nozzle to constrain, direct, and control the plasma gas in order to control the arc of plasma gas generated by the torch.

FIG. 1 illustrates a typical example of a prior art nozzle 10. The nozzle 10 is symmetrically formed about a longitudinal nozzle axis 12, and has an orifice 14 that forms a passage through the nozzle 10 that is symmetrically formed about the nozzle axis 12. Typically, the orifice is generally cylindrical, and the nozzle 10 shown has a cylindrical orifice sidewall 16 that is stepped, having two cylindrical portions 18 and 20. The nozzle 10 also has a gas-directing surface 22 that is symmetrically disposed about the nozzle axis 12, and which extends normal thereto, joining to a nozzle interior sidewall 23 that is symmetrically disposed about the nozzle axis 12 and extends parallel to thereto, forming a cylinder centered on the nozzle axis 12. An orifice inlet 24 joins to the orifice sidewall 16 and to the gas-directing surface 22, and in the nozzle 10 is formed as a shallow cone centered on the nozzle axis 12. The inlet 24 is formed as a surface of rotation generated by rotating a line segment 26 about the nozzle axis 12, and the line segment 26 joins to the gas-directing surface 22 at an outer junction point 28, which defines an inlet diameter D, and joins to the orifice sidewall 16 at an inner junction point 30. The longitudinal distance of the inner junction point 30 from the plane in which the gas-directing surface 22 resides defines a nozzle depth Z. The nozzle 10 partially surrounds an electrode 32 having an emissive insert 34, and serves to control the flow of plasma gas that sustains the arc generated from the emissive insert 34.

In most cases, the plasma gas is introduced into the interior space of the nozzle 10 surrounding the electrode 32 (this space being partially defined by the nozzle interior sidewall 23 and the gas-directing surface 22) via a swirl ring (not shown) that directs the gas tangential to the nozzle interior sidewall 23 to form a swirling vortex. The gas-directing surface 22 serves to redirect the flow of plasma gas toward the orifice 14, and the orifice inlet 24 serves to transition the gas flow into the orifice 14, through which the gas passes. The conical orifice inlet 24 changes abruptly at the intersection with the orifice sidewall 16 at the inner junction point 30, this abrupt change tending to disturb the swirling gas flow.

SUMMARY

Plasma arc torches employ a nozzle, one purpose of which is to constrain and direct the plasma gas in order to control the plasma arc to provide the desired performance of the torch. The present invention provides a profile for an orifice inlet that provides a smooth transition of gas flow into a nozzle orifice of the nozzle for a plasma arc torch, where the inlet employs a variable curvature that has been found to provide increased stability and reduced constriction of the plasma arc, allowing increased gas pressure and flow to be employed. The increased stability allows for the use of greater gas pressure and flow rate, resulting in improved cut quality and faster maximum cutting speed. Reducing the cutting speed to the maximum cutting speed of the comparable prior art torch should allow a greater thickness of material to be cut at that speed.

The nozzle is symmetrical about a nozzle axis, and has a nozzle orifice formed with an orifice sidewall that is centered on the nozzle axis of the nozzle. The nozzle also has a nozzle interior sidewall symmetrically disposed about the nozzle axis, partially defining an interior space of the nozzle in which an electrode of the torch is positioned. In many cases, a gas-directing surface extends inwards from the nozzle interior sidewall toward the nozzle axis, serving to redirect the flow of gas toward the orifice. The orifice sidewall is typically configured with a generally cylindrical overall form, being a surface of rotation defined by rotation of one or more elements that extend generally parallel to the nozzle axis. In addition to being cylindrical, the orifice sidewall can be flared, steeply conical, and/or stepped with segments that are cylindrical, flared, or steeply conical; these various configurations, known in the art, are considered generally cylindrical.

The nozzle of the present invention has an orifice inlet that joins to the orifice sidewall and extends toward the nozzle interior sidewall; when a gas-directing surface is employed, the orifice inlet joins to the gas-directing surface, extending between the gas-directing surface and the nozzle orifice. The orifice inlet has a variably-curved contour that promotes smooth flow of gas into the orifice, which reduces instability of the resulting arc when the plasma gas is ionized.

The variable curvature of the inlet is defined by a variably-curved element, and at least a segment of the orifice inlet is formed as a surface of rotation generated by rotating the variably-curved element about the nozzle axis. The variably-curved element has a curvature that increases as the orifice sidewall is approached, so as to gradually transition of the gas flow from the nozzle interior space into the orifice. This curvature provides an inclination to the nozzle axis that decreases with an increasing rate as the nozzle axis is approached. The variably-curved element is a portion of a curve selected from a group of conic sections, and could be a portion of an ellipse, parabola, or hyperbola; a close approximation of such curves may be employed to ease fabrication by linear interpolation or similar techniques. The variably-curved element is typically positioned such that the orifice sidewall is substantially tangent to the variably-curved element at an inner junction point where the orifice sidewall joins to the orifice inlet. One definition of being substantially tangent is that an extension line truly tangent to the variably-curved element at the inner junction point be either coincident with the orifice sidewall at the inner junction point, or is inclined with respect to the orifice sidewall by an angle of less than 15°. When the nozzle includes a gas-directing surface, the variably-curved element is typically also positioned such that the gas-directing surface is substantially tangent to the variably-curved element at an outer junction point where the gas-directing surface joins the orifice inlet.

When the variably-curved element is a portion of an ellipse, the ellipse is typically oriented such that its major axis is angled with respect to the nozzle axis by an angle $\delta$ of between about 40° and 90°. The ellipse is also selected such that its major axis is significantly greater than its minor axis, such that the ratio of the major axis to the minor axis is at least 2:1, and more preferably at least 3:1. In preliminary testing, a ratio of axes of 4.5:1 was found to be particularly effective at 125 amps, providing a desirable degree of stability of the plasma arc, and resulting in an increased (about 20% greater) maximum cutting speed compared to a nozzle that was similar except for having a shallow conical orifice inlet (such as shown in FIG. 1 and discussed above) where the diameter and depth of the conical inlet were the same as the depth and diameter of the elliptical inlet, and where the elliptical inlet was a surface of rotation generated by rotating an elliptical form having the same points of junction with the orifice sidewall and the gas-directing surface as the line segment defining the conical inlet. This improved cutting performance was achieved with no decrease in the useful life of the nozzle. Substituting an orifice inlet defined by an elliptical cross section for a shallow conical orifice inlet such as employed in the prior art allows the transition of the gas vortex into the orifice to be achieved with less disruption than has been previously possible without significantly changing the orifice length or the arc chamber volume.

Depending on the particular nozzle configuration, similar benefits may be achieved by employing variably-curved elements that are a portion of a parabola or a portion of a hyperbola. These curves should have a geometry providing a curve with overall dimensions similar to those provided by ellipses within the range specified above. In some cases, the orifice inlet may be segmented to suit the particular nozzle application, in which case the orifice inlet may have a variably-curved segment defined by a variably-curved element as discussed above, in combination with one or more additional segments that may be cylindrical, conical, or flared.

DETAILED DESCRIPTION

Figure 2:
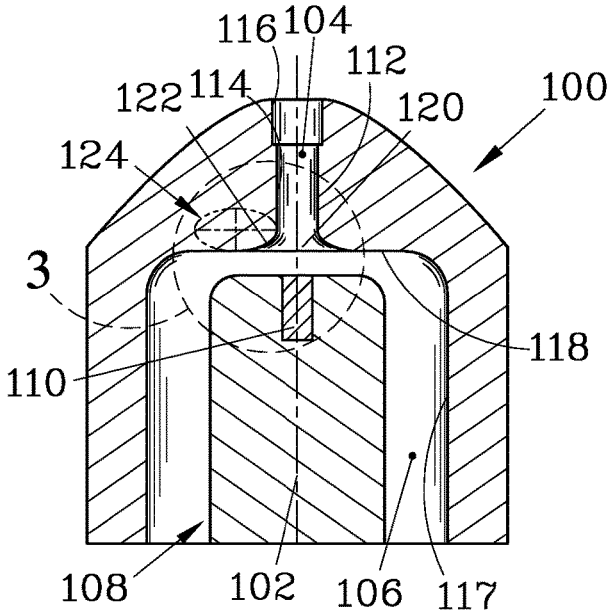
FIG. 2 is a partial section view illustrating a nozzle of the present invention, which has an orifice sidewall and a gas-directing surface that are joined by a variably-curved inlet, where the variably-curved contour of the inlet is defined by rotation of an elliptical element about a nozzle axis. The elliptical orifice inlet serves to guide gas smoothly into the orifice to reduce instability and constriction of the resulting plasma arc.
Figure 3:
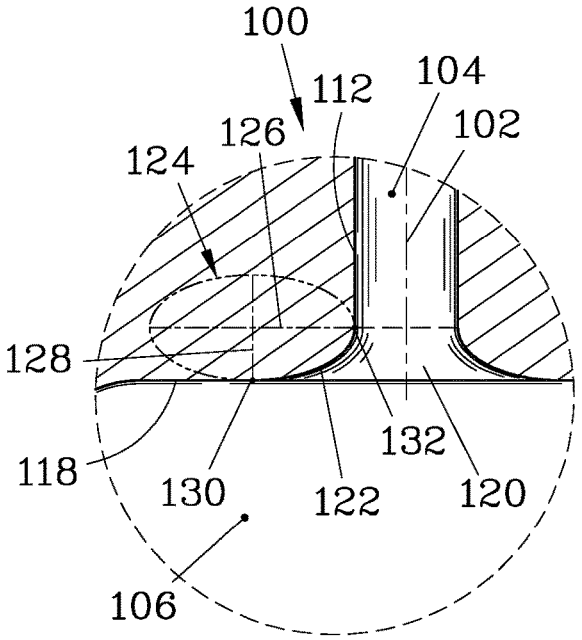
FIG. 3 is an enlarged view of the Region 3 shown in FIG. 2, more clearly illustrating the geometry of the elliptical element that defines the orifice inlet. The elliptical element of this embodiment is a portion of an ellipse that is oriented with its major axis extending perpendicular to the nozzle axis, and its minor axis parallel to the nozzle axis. The ellipse is further positioned such that the elliptical element is joined to a gas directing surface in a tangential manner, and is also joined to the orifice sidewall of the nozzle orifice in a tangential manner.

FIGS. 2 and 3 illustrate a plasma arc torch nozzle 100 that forms one embodiment of the present invention. The nozzle 100 has a longitudinal nozzle axis 102 and an orifice 104 that is centered on the nozzle axis 102 and communicates with an interior space 106 that partially encloses an electrode 108 that is provided with an emissive insert 110. The orifice 104 is partly defined by a generally cylindrical orifice sidewall 112 that is centered on the nozzle axis 102. While the orifice 104 illustrated is stepped, having two cylindrical segments (114, 116), it should be appreciated by one skilled in the art that the orifice could be formed with one or more flared and/or steeply conical surfaces. The interior space 106 is partly bounded by a nozzle interior sidewall 117 that, in the nozzle 100, is a cylindrical surface centered on the nozzle axis 102. The interior space 106 is also bounded by a gas-directing surface 118 that is symmetrically disposed about the nozzle axis 102 and resides in a plane normal to the nozzle axis 102.

An orifice inlet 120 joins the gas-directing surface 118 to the orifice sidewall 112. The inlet 120 has a variably-curved surface defined by a variably-curved element that, in the nozzle 100, is an elliptical element 122. The variably-curved surface of the inlet 120 is a surface of rotation generated by rotating the elliptical element 122 about the nozzle axis 102. As better shown in the enlarged view of FIG. 3, the elliptical element 122 is a portion of an ellipse 124, having a major axis 126 and a minor axis 128. The ellipse 124 is oriented such that the major axis 126 extends normal to the nozzle axis 102 (and thus is parallel to the plane of the gas-directing surface 118), and the minor axis 128 is parallel to the nozzle axis 102. The ellipse 124 is further positioned such that the elliptical element 122 joins to the gas-directing surface 118 at one end of the minor axis 128, and joins to the orifice sidewall 112 at one end of the major axis 126. The position of an outer junction point 130 where the elliptical element 122 joins to the gas-directing surface 118 results in the gas-directing surface 118 being tangent to the ellipse 124 at the outer junction point 130. Similarly, the position of an inner junction point 132 where the elliptical element 122 joins to the orifice sidewall 112 results in the orifice sidewall 112 being tangent to the ellipse 124 at the inner junction point 132. The position of the elliptical element 122 causes its inclination with respect to the nozzle axis 102 to decrease at an increasing rate as its distance from the nozzle axis 102 decreases, until the elliptical element 122 is substantially parallel to the nozzle axis 102 at the inner junction point 132.

Figure 1:
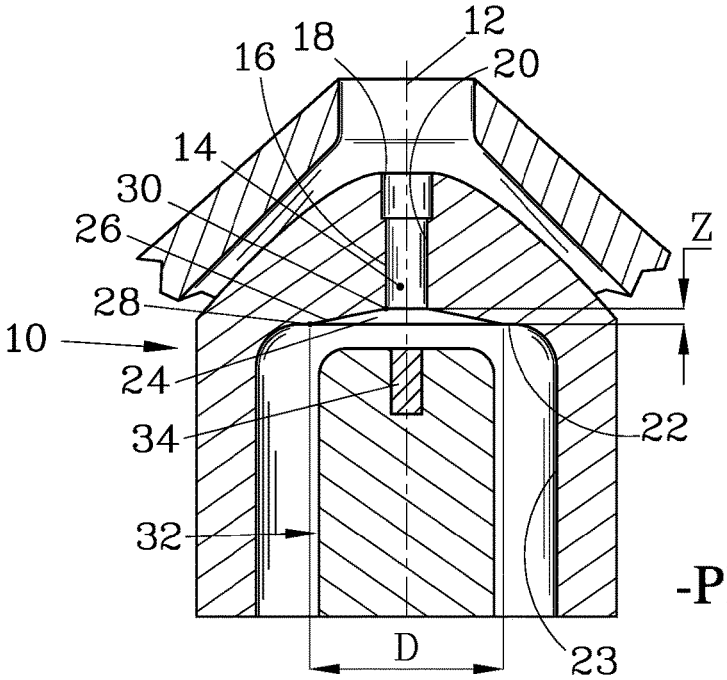
FIG. 1 is a partial section view illustrating a prior art nozzle that has an orifice and a gas-directing surface that are joined by a shallow conical orifice inlet to aid in guiding gas flow into the orifice.

While the ellipse 124 is illustrated with a ratio of it major axis 126 to its minor axis 128 of about 2:1, preliminary testing in a 125 amp torch indicated that greater ratios provide better cutting performance, suggesting that they provide a greater reduction of instability of the plasma arc during use. For the 125 amp nozzles tested, a ratio of the axes (126, 128) of 3:1 appeared to be a more practical minimum ratio than 2:1, providing significantly better quality cuts. The nozzle employing a 3:1 ratio provided a 5% higher optimal cutting speed and 8.4% higher maximum cutting speed compared to a prior art nozzle employing a conical orifice inlet, such as shown in FIG. 1. A nozzle with a ratio of 1.625:1 was found to be impractical, due to poor quality of the cut and difficulty in transferring the arc to the workpiece. A nozzle having a ratio of 4.5:1 (as discussed below with regard to FIG. 6) was found to provide the best performance of the ratios tested, producing high-quality cuts and a significantly faster maximum cutting speed than the nozzle having a 3:1 ratio, as well as improved performance compared to the prior art nozzle having a conical orifice inlet. Maximum cutting speed is defined as the maximum speed at which a particular material of a defined thickness can be severed; each test was repeated three times in a controlled laboratory setting. Cut quality was determined based on multiple characteristics of the cut material, including dross, angle and width of kerf, trail of cut, and the resulting finish of the cut faces.

Figure 4:
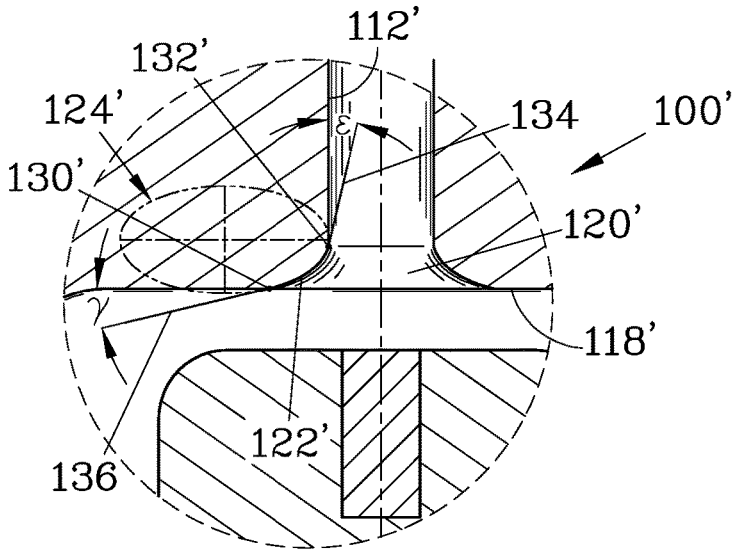
FIG. 4 illustrates a region similar to that shown in FIG. 3, for an alternative nozzle with an orifice inlet defined by an elliptical element that is a portion of an ellipse positioned such that the elliptical element joins to the orifice sidewall at a slight angle and joins to the gas-directing surface at a slight angle. The junctions are such that extension lines tangent to the ellipse at the junction points are inclined with respect to the orifice sidewall and the gas-directing surface by a small angle.
Figure 5:
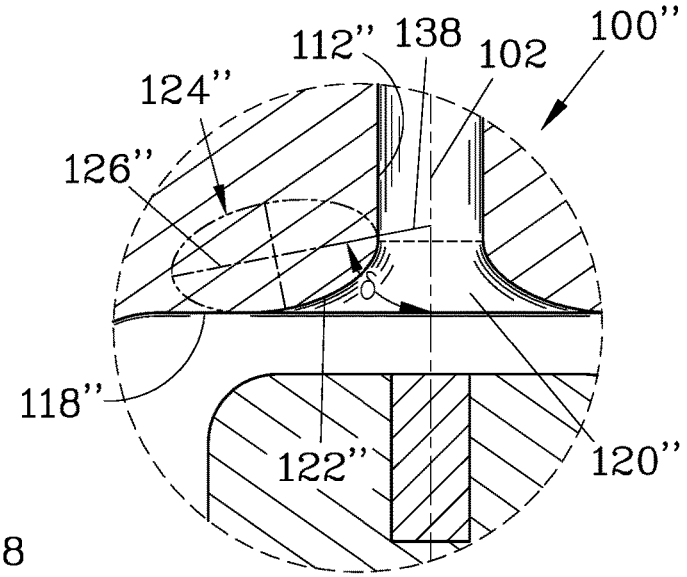
FIG. 5 illustrates a region similar to that shown in FIGS. 3 and 4, for another alternative nozzle. In this nozzle, the inlet is defined by an elliptical element that is a portion of an ellipse that is oriented with its major and minor axes inclined with respect to the nozzle axis, rather than with the major axis being perpendicular and the minor axis being parallel.

FIGS. 4 and 5 illustrate some examples of slight variations in geometry that are possible for nozzles employing a portion of an ellipse as the variably-curved element. Such variations may allow the freedom to better match the contour of the orifice inlet to a desired situation, while still providing the benefit of the present invention.

FIG. 4 is a partial view of a nozzle 100', the area shown in FIG. 4 corresponding to that shown in FIG. 3 for the nozzle 100. The nozzle 100' has an orifice inlet 120' defined by rotation of an elliptical element 122', where the elliptical element 122' is a portion of an ellipse 124' which is similar to the ellipse 124 shown in FIGS. 2 and 3, but which is positioned relative to an orifice sidewall 112' such that it intersects and passes partially through the orifice sidewall 112', and the orifice sidewall 112' joins to the elliptical element 122' at a slight angle. The elliptical element 122' joins to the orifice sidewall 112' at an inner junction point 132' positioned such that an extension line 134, which is tangent to the ellipse 124' at the inner junction point 132', is inclined with respect to the orifice sidewall 112' by an angle c. The angle ε should be maintained small to maintain the junction substantially tangential; it is felt that the inclination should be maintained less than 15° for most applications.

The ellipse 124' is also positioned relative to a gas-directing surface 118' such that it intersects the gas-directing surface 118', and the gas-directing surface 118' joins to the elliptical element 122' at a slight angle, at an outer junction point 130'. An extension line 136 that is tangent to the ellipse 124' at the outer junction point 130' is inclined with respect to the gas-directing surface 118' by an angle γ; again, the angle γ should be small, and should be maintained less than 15° for most applications.

FIG. 5 is a partial view of a nozzle 100" which forms another embodiment of the present invention. In the nozzle 100", an orifice inlet 120" has a variable curvature and is a surface of rotation defined by an elliptical element 122" that is a portion of an ellipse 124". The ellipse 124" is similar to the ellipse 124 shown in FIGS. 2 and 3, but is oriented with its major axis 126" inclined with respect to the nozzle axis 102, rather than perpendicular thereto. An extension line 138 projecting from and extending the major axis 126' intersects the nozzle axis 102 at an angle δ which is at least 40° and not more than 90°. The ellipse 124" is positioned such that the elliptical element 122" is joined to both a gas-directing surface 118" and an orifice sidewall 112" in a tangential manner, similarly to the elliptical element 122 shown in FIGS. 2 and 3 and discussed above.

Figure 6:
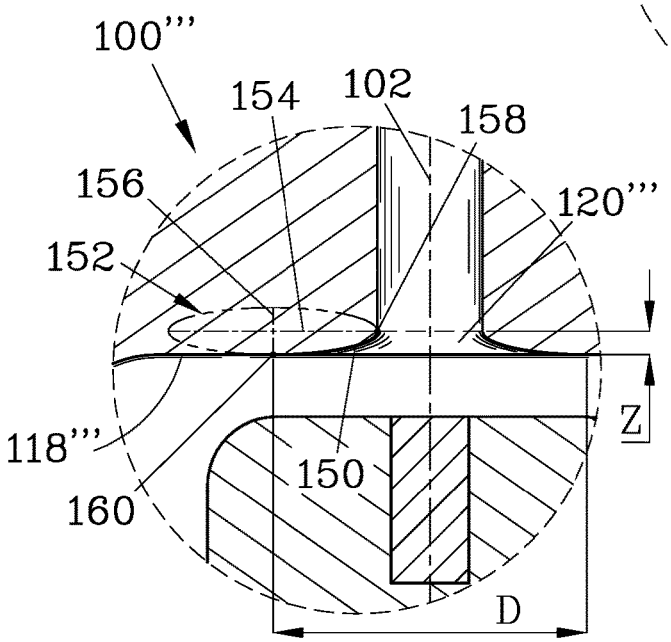
FIG. 6 illustrates a region similar to that shown in FIGS. 3-5, but for a nozzle having an orifice inlet defined by a portion of an ellipse with a ratio of major axis to minor axis of about 4.5:1.

FIG. 6 is a partial view of a nozzle 100' having an orifice inlet 120''' with a variably-curved contour defined by an elliptical element 150 that is a portion of an ellipse 152, the inlet 120" again being formed as a surface of rotation generated by rotating the elliptical element 150 about the nozzle axis 102. The ellipse 152 differs from the ellipse 124 shown in FIGS. 2 and 3 in having a major axis 154 and a minor axis 156 where the ratio of the major axis 154 to the minor axis 156 is about 4.5:1. With this ratio, the elliptical element 150 joins to an orifice sidewall 112''' at an inner junction point 158, and joins to a gas-directing surface 118''' at an outer junction point 160. The outer junction point 160 defines an orifice diameter D, while the longitudinal distance of the inner junction point 158 from the plane in which the gas-directing surface 118''' resides defines an orifice depth Z. When compared to a prior art nozzle having a conical orifice inlet (such as shown in FIG. 1) with the same diameter D and depth Z in a 125 A torch, the nozzle 100''' was found to provide a 5% greater optimum cutting speed, and a 20% higher maximum cutting speed, with a comparable cut quality and no decrease in useful life of the nozzle.

Figure 7:
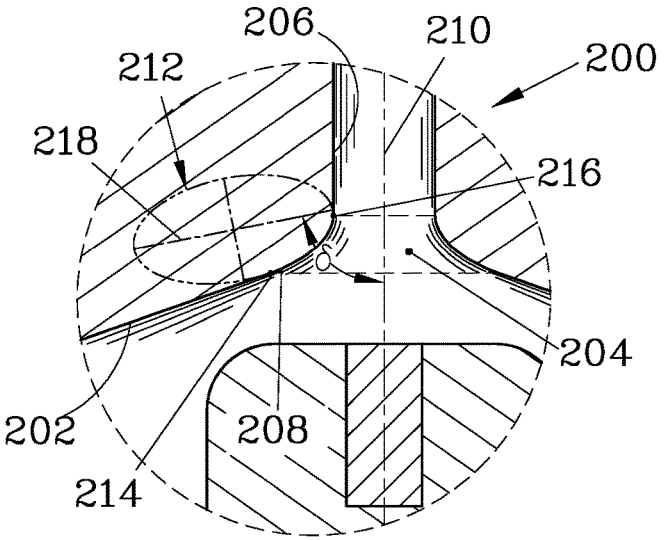
FIG. 7 illustrates a region of a sectioned nozzle having a gas-directing surface that is formed as a shallow cone. The nozzle has an orifice inlet that is variably curved, being defined as a surface of rotation of a variably-curved element that is a portion of an ellipse. The gas-directing surface and the orifice sidewall both join tangentially to the ellipse.

The orifice inlet of the present invention, having a variably-curved surface contour, can be employed in various nozzle configurations. FIG. 7 illustrates a region of a sectioned nozzle 200 that has a gas-directing surface 202 that is formed as a shallow cone. A variably-curved orifice inlet 204 joins the gas-directing surface 202 to an orifice sidewall 206, and is defined as a surface of rotation generated by rotating a variably-curved element 208 about a nozzle axis 210. The variably-curved element 208 is a portion of an ellipse 212. The gas-directing surface 202 and the orifice sidewall 206 respectively join tangentially to the ellipse 212 at an outer junction point 214 and an inner junction point 216, and the ellipse 212 is positioned with a major axis 218 inclined to the nozzle axis 210 by an angle δ.

Figure 8:
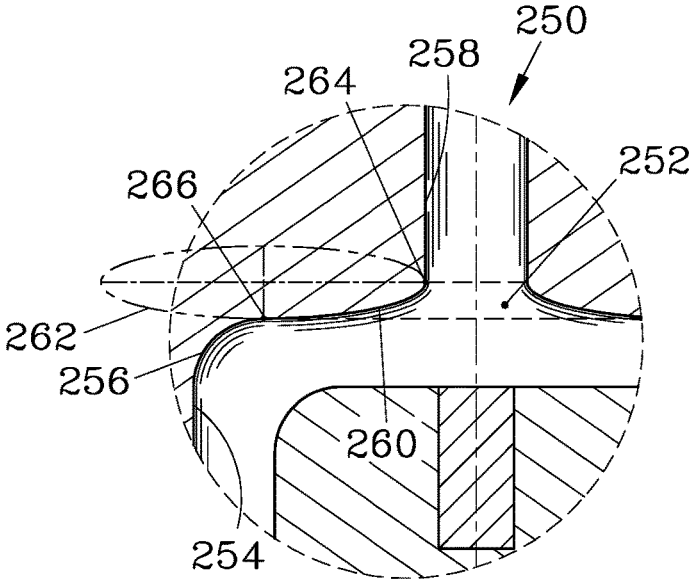
FIG. 8 illustrates a region of a sectioned nozzle where an orifice inlet is joined to a nozzle interior sidewall by a radiused section, and no gas-directing surface is employed. The nozzle has an orifice sidewall that is tangent to an ellipse that defines the orifice inlet at the junction where the orifice sidewall joins to the orifice inlet.

FIG. 8 illustrates a region of a sectioned nozzle 250 having a variably-curved orifice inlet 252 that is joined to a nozzle interior sidewall 254 by a radiused section 256, and to an orifice sidewall 258. The nozzle 250 does not employ a gas-directing surface between the radiused section 256 and the orifice inlet 252. The orifice inlet 252 is again defined by rotation of a variably-curved element 260, which is a portion of an ellipse 262. The orifice sidewall 258 is tangent to the ellipse 262 at an inner junction point 264 where the orifice sidewall 258 joins to the orifice inlet 252, and the radiused section 256 is tangent to the ellipse 262 at an outer junction point 266 where the radiused section 256 joins to the orifice inlet 252.

Figure 9:
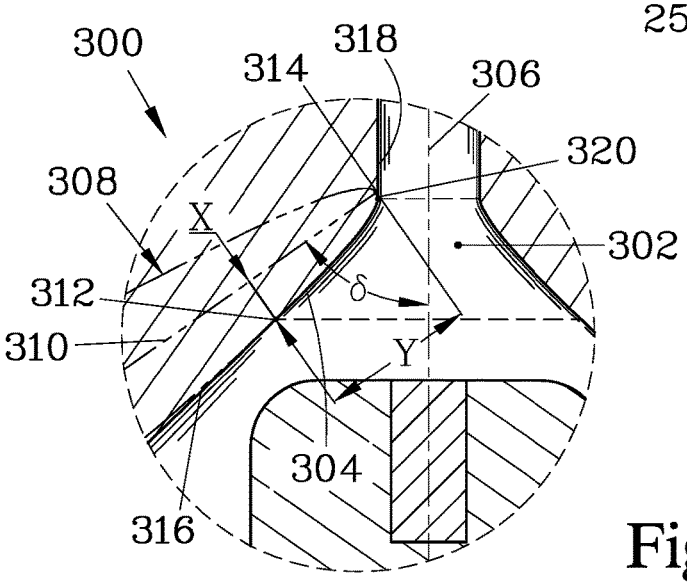
FIG. 9 illustrates a region of a sectioned nozzle having an orifice inlet where the variable curvature is defined by a portion of a parabola, rather than an ellipse. The parabola has an axis of symmetry that is inclined with respect to the nozzle axis by an angle $\delta$. A conical gas-directing surface and an orifice sidewall are each tangent to the parabola where they join to the orifice inlet.

FIG. 9 illustrates a region of a sectioned nozzle 300 having an orifice inlet 302 that is again defined as a surface of rotation generated by rotating a variably-curved element 304 about a nozzle axis 306; however, in the nozzle 300, the variably-curved element 304 is a portion of a parabola 308, rather than a portion of an ellipse as employed in the embodiments discussed above. The parabola 308 has an axis of symmetry 310 that is inclined with respect to the nozzle axis 306 by an angle δ. The parabola 308 is further defined by the ratio of a displacement X of the parabola 308 from the axis of symmetry 310 at an outer junction point 312 and an axial separation Y of the outer junction point 312 from a vertex 314 of the parabola 308 measured along the axis of symmetry 310; the ratio of X:Y should be within a range of 1:20 to 1:4.

The nozzle 300 also has a conical gas-directing surface 316 that is tangent to the parabola 308 at the outer junction point 312 where the gas-directing surface 316 joins to the orifice inlet 302, and an orifice sidewall 318 that is tangent to the parabola 308 at an inner junction point 320 where the orifice sidewall 318 joins to the orifice inlet 302. It is felt that parabolic surfaces or hyperbolic surfaces (as discussed below with reference to FIG. 10) may be better suited than elliptical surfaces for use with conical gas-directing surfaces.

Figure 10:
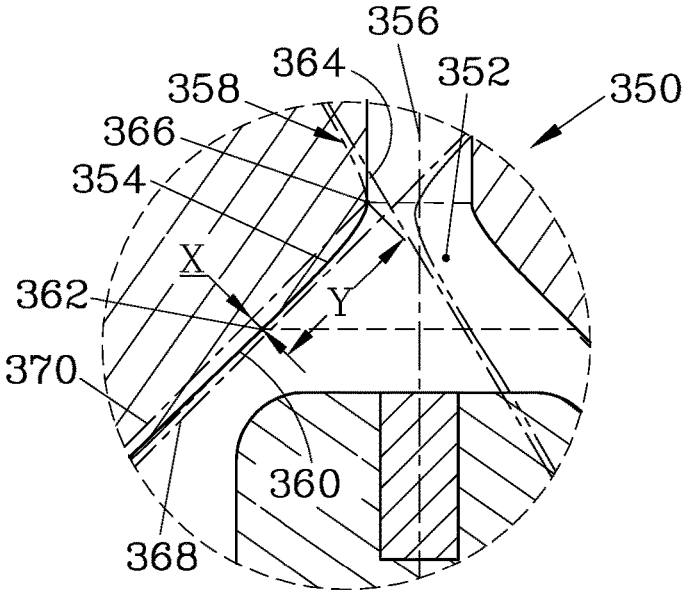
FIG. 10 illustrates a region of a sectioned nozzle having an orifice inlet where the variable curvature is defined by a portion of a hyperbola, rather than an ellipse or parabola. The hyperbola has a reference line that is parallel to one of its asymptotes and passing through an inner junction point. A conical gas-directing surface and an orifice sidewall are each tangent to the hyperbola at junction points where they join to the orifice inlet.

FIG. 10 illustrates another region of a sectioned nozzle 350, which in this embodiment has an orifice inlet 352 defined by rotating a variably-curved element 354 about a nozzle axis 356. The variably-curved element 354 of this embodiment is a portion of a hyperbola 358, and joins to a gas-directing surface 360 at an outer junction point 362, and to an orifice sidewall 364 at an inner junction point 366. As the hyperbola 358 extends from the inner junction point 366 toward the outer junction point 362, it curves to approach an asymptote 368. A reference line 370 can be defined as a line parallel to the asymptote 368 and passing through the inner junction point 366. The curvature of the hyperbola 358 results in a ratio of a displacement X of the hyperbola 358 from the reference line 370 at the outer junction point 362 and a reference separation Y of the outer junction point 362 from the inner junction point 366, measured along the reference line 370; the ratio of X:Y should be within the range from 1:15 to 1:2.

Figure 11:
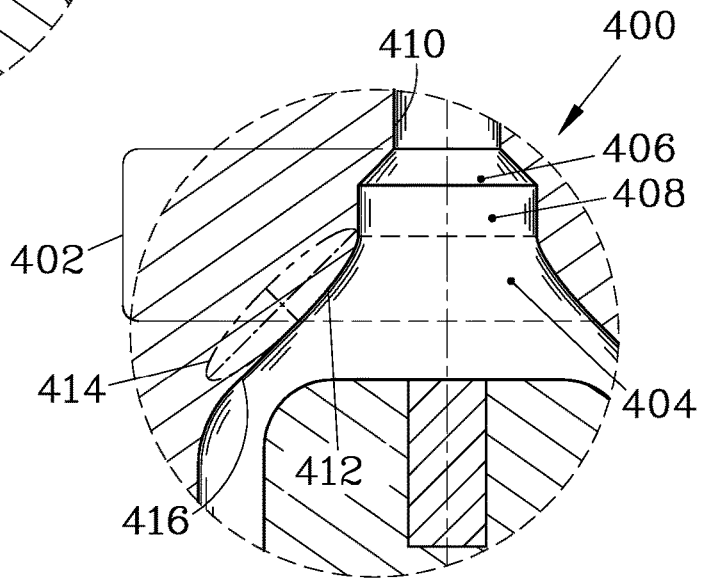
FIG. 11 illustrates a region of a sectioned nozzle having a complex orifice inlet that has a supplementary inlet section that includes a conical segment that joins to the orifice sidewall and a cylindrical segment, as well as a variably-curved segment. The variably-curved segment has an elliptical curvature, defined by a portion of an ellipse to which the cylindrical segment is tangent, and to which a conical gas-directing surface is also tangent.

FIG. 11 illustrates a region of a sectioned nozzle 400 having a complex orifice inlet 402 that has multiple segments, including a variably-curved segment 404, as well as a conical segment 406 and a cylindrical segment 408. The conical segment 406 joins to an orifice sidewall 410, while the cylindrical segment 408 joins between the conical segment 406 and the variably-curved segment 404. The variably-curved segment 404 has an elliptical curvature, defined by a variably-curved element 412 that is a portion of an ellipse 414, to which the cylindrical segment 408 is tangent, and to which a conical gas-directing surface 416 is also tangent.

Figure 12:
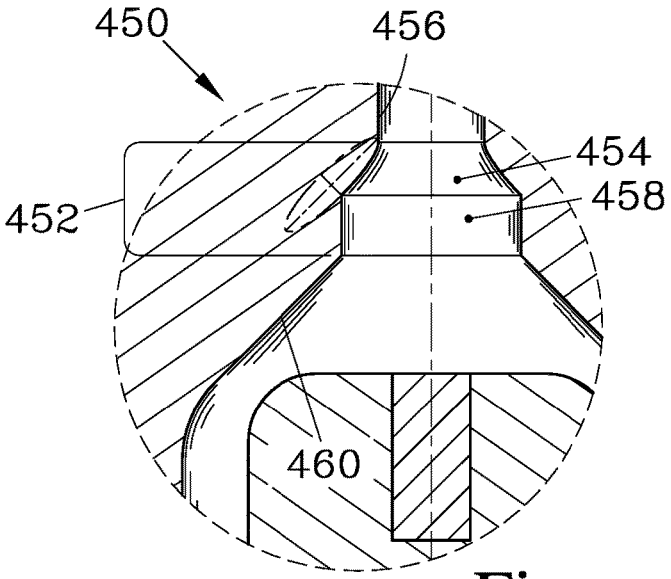
FIG. 12 illustrates a region of a sectioned nozzle that again has a complex orifice inlet, where the orifice inlet has a variably-curved segment, which joins to the orifice sidewall in a tangential manner, as well as having a cylindrical segment that joins to a conical gas-directing surface.

FIG. 12 illustrates a region of a sectioned nozzle 450 that again has a complex, segmented orifice inlet 452. In the nozzle 450, the orifice inlet 452 has a variably-curved segment 454 that joins to an orifice sidewall 456 in a tangential manner, as well as having a cylindrical segment 458 that joins to the variably-curved segment 454. A conical gas-directing surface 460 joins to the cylindrical segment 458. It should be appreciated that an additional variably-curved segment, such as the segment 404 shown in FIG. 11, could be employed to join the gas-directing surface 460 to the cylindrical segment 458 or, in some cases, could join tangentially to the gas-directing surface 460 and terminate at the variably-curved segment 454 at the location where the variably-curved segment 454 joins to the cylindrical segment 458.

It should also be noted that common CNC controls are not capable of producing a perfect ellipse, parabola, or hyperbola, and that contours defined by such complex curves must be produced by the use of a form cutting tool or by linear interpolation (cutting multiple short linear steps that closely approximate the desired curve). It is desirable that the tool path closely follows the geometry of the desired curve in order to allow gas to flow smoothly over the linearly interpolated curved surface. In testing, curved surfaces formed from linear segments limited to 0.30 mm in length have been found to give the appearance of a smooth curve to the naked eye. It should be appreciated that larger segments would still derive some of the benefits of the invention, and the size of segments that can be employed effectively for a particular application can be determined experimentally. It is preferred that a peak-to-valley limit be applied, where the peak-to-valley tolerance is the total deviation from the desired curve at any point along the curve. A preferred peak-to-valley tolerance is 0.03 mm.

While the novel features of the present invention have been described in terms of particular embodiments and preferred applications, it should be appreciated by one skilled in the art that substitution of materials and modification of details can be made without departing from the spirit of the invention.

What is claimed is:

1. A nozzle for a plasma arc torch, the nozzle having a longitudinal nozzle axis, the nozzle comprising:

a nozzle orifice centered on the nozzle axis and having an orifice sidewall;

a nozzle interior sidewall symmetrically disposed about the nozzle axis;

an orifice inlet joining to said orifice sidewall and extending toward said nozzle interior sidewall, said orifice inlet including a variably curved surface that is formed as a surface of rotation generated by rotating a variably-curved element about the nozzle axis, the variably-curved element having a continuously changing curvature and an inclination with respect to the nozzle axis that decreases at an increasing rate with decreasing radial distance from the nozzle axis, the variably-curved element being a portion of an ellipse selected from the group of ellipses having a major axis and a minor axis, wherein a ratio of the major axis to the minor axis is within a range from 2:1 to 10:1;

said orifice sidewall joins to said variably-curved surface at an inner junction point, the variably-curved element is positioned such that said orifice sidewall is tangent to the variably-curved element at the inner junction point; and a gas-directing surface symmetrically disposed about the nozzle axis and joining to said nozzle interior sidewall, said gas-directing surface joining to said orifice inlet at an outer junction point, said gas-directing surface being tangent to the variably-curved element at the outer junction point.

2. The nozzle of claim 1 wherein the ratio of the major axis to the minor axis of the ellipse is at least 3:1, and the major axis of the ellipse is oriented with respect to the nozzle axis by an angle δ that is between 40° and 90°.

3. The nozzle of claim 1 wherein the ratio of the major axis to the minor axis of the ellipse is at least 4.5:1.

4. The nozzle of claim 3 wherein the major axis of the ellipse is perpendicular to the nozzle axis.

5. The nozzle of claim 1 wherein the variably-curved element is parallel to the nozzle axis at the inner junction point.

6. A nozzle for a plasma arc torch, the nozzle having a longitudinal nozzle axis, the nozzle comprising:

a nozzle orifice centered on the nozzle axis and having an orifice sidewall;

a nozzle interior sidewall symmetrically disposed about the nozzle axis;

an orifice inlet joining to said orifice sidewall and extending toward said nozzle interior sidewall, said orifice inlet including a variably-curved surface that is formed as a surface of rotation generated by rotating a variably-curved element about the nozzle axis, the variably-curved element having a continuously changing curvature and an inclination with respect to the nozzle axis that decreases at an increasing rate with decreasing radial distance from the nozzle axis, the variably-curved element terminating at an inner junction point and an outer junction point, said orifice sidewall joins to said variably-curved surface at the inner junction point, further wherein the variably-curved element is positioned such that said orifice sidewall is tangent to the variably-curved element at the inner junction point; and a gas-directing surface symmetrically disposed about the nozzle axis and joining to said nozzle interior sidewall, said gas-directing surface joining to said orifice inlet at the outer junction point, said gas-directing surface being tangent to the variably-curved element at the outer junction point;

wherein the variably-curved element further being a portion of a conic section selected from the group of:

ellipses having a major axis and a minor axis, where a ratio of the major axis to the minor axis is within a range from 2:1 to 10:1, parabolas having an axis of symmetry and a vertex, and wherein the outer junction point defines a displacement X from the axis of symmetry and an axial separation Y measured along the axis of symmetry from the inner junction point, further wherein a ratio of X:Y is within a range from 1:20 to 1:4, and hyperbolas having asymptotes, wherein the outer junction point defines a displacement X from a reference line defined as parallel to an asymptote of the hyperbola and passing through the inner junction point, the outer junction point also defining a reference separation Y of the outer junction point from the inner junction point as measured along the reference line, further wherein a ratio of X:Y is within a range from 1:15 to 1:2.

7. The nozzle of claim 6 wherein the conic section is a parabola.

8. The nozzle of claim 6 wherein the conic section is a hyperbola.

* * * * *